United States Patent [19]

Pennypacker

[11] 4,443,980

[45] Apr. 24, 1984

[54] PULLING IRON ENCLOSURE

[75] Inventor: J. Edward Pennypacker, Birchrunville, Pa.

[73] Assignee: Pennsylvania Insert Corporation, Devault, Pa.

[21] Appl. No.: 245,298

[22] Filed: Mar. 19, 1981

[51] Int. Cl.[3] ..... E04D 15/00

[52] U.S. Cl. ..... 52/125.4; 52/701; 52/706

[58] Field of Search ..... 52/124.2, 125.5, 699, 52/700, 701, 706, 707, 704, 125.4, 128

[56] References Cited

U.S. PATENT DOCUMENTS

| | | | |
|---|---|---|---|
| 997,547 | 7/1911 | Fawcett | 52/124.2 |
| 1,244,034 | 10/1917 | Cummings | 52/706 |
| 1,266,128 | 5/1918 | Kelly | 52/706 X |
| 2,199,533 | 5/1940 | Wuellner | 52/699 |
| 2,957,279 | 10/1960 | McNair | 52/701 |
| 3,099,108 | 7/1963 | Kalkbrenner | 52/704 X |
| 3,159,945 | 12/1964 | La Morte | 52/706 |
| 3,276,176 | 10/1966 | Jonsson et al. | 52/704 X |
| 3,298,148 | 1/1967 | Dickson | 52/706 X |
| 3,916,590 | 11/1975 | Miller | 52/124.2 |
| 4,087,947 | 5/1978 | Turner | 52/699 X |

FOREIGN PATENT DOCUMENTS

| | | | |
|---|---|---|---|
| 2119875 | 8/1972 | France | 52/125.5 |

*Primary Examiner*—Carl D. Friedman

*Attorney, Agent, or Firm*—Seidel, Gonda & Goldhammer

[57] ABSTRACT

A pulling iron enclosure is provided for recessing a pulling iron in a wall of an underground vault. The enclosure is defined by a base and a removable cover. The enclosure has a cavity therein with the cover overlying one side of the cavity. A wall of the enclosure has an opening through which a pulling iron may extend for positioning the pulling iron in the cavity so that the pulling iron will be readily accessible in said cavity when the enclosure and pulling iron are embedded in a wall of the vault.

19 Claims, 6 Drawing Figures

PULLING IRON ENCLOSURE

BACKGROUND

It is known to provide a wall of a vault with a pulling iron. For example, see U.S. Pat. No. 3,916,590. As shown in said patent, the pulling iron extends into the chamber of the vault and requires a slot to be made in one of the walls of the mold used to construct the vault.

It is desirable to mount the pulling iron within the wall of the vault for access to an operator within the vault. It is known to create a cavity in a wall of a vault by placing foam plastic or foam rubber into a mold before casting the vault. In view of the desire to have a cavity with the pulling iron disposed within the cavity, it is not possible or practical to create the cavity by use of foam plastic or rubber.

SUMMARY OF THE INVENTION

The present invention is directed to apparatus for recessing a pulling iron in a wall of a vault such as a vault precast from concrete. The apparatus comprises an enclosure defined by a base and a removable cover. The enclosure has a cavity therein and the cover overlies one side of the cavity. A wall of the enclosure has an opening through which a pulling iron may extend for positioning of the pulling iron in the cavity. The enclosure is provided with means for mounting the enclosure in a mold with a face of the cover juxtaposed to a wall of the mold.

It is an object of the present invention to provide a novel enclosure for facilitating recessing a pulling iron in a wall of a precast concrete vault.

It is another object of the present invention to provide an inexpensive, reliable and easy to use enclosure adapted to be molded in a wall of a vault and receiving therein a pulling iron positioned for ready access from within the vault.

It is another object of the present invention to provide a pulling iron enclosure adapted to be recessed in a wall of a vault with no exposed edges for improved appearance and resistance to entry of water.

Other objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
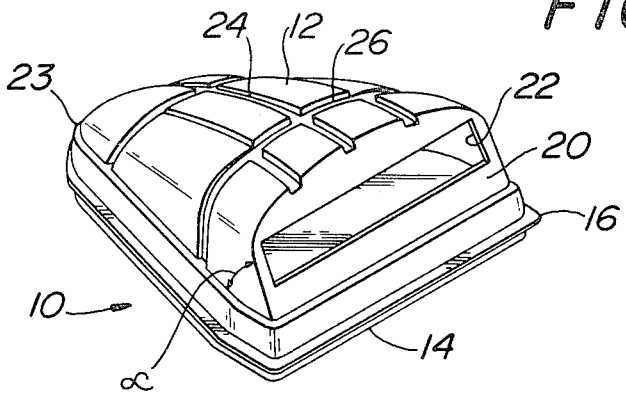
FIG. 1 is a perspective view of an enclosure in accordance with the present invention.

Referring to the drawings in detail, wherein like numerals indicate like elements, there is shown in FIG. 1 a perspective view of a pulling iron enclosure in accordance with the present invention designated generally as 10. The enclosure 10 is defined by a base 12 and a removable cover 14. The base 12 is injected molded or vacuum formed from a rigid polymeric plastic such as ABS, high impact styrene, etc. so that it may resist handling by workers as well as the pressure of concrete when the enclosure is mounted in a mold. Base 12 may have a wall thickness of 0.040 to about 0.080.

Figure 2:
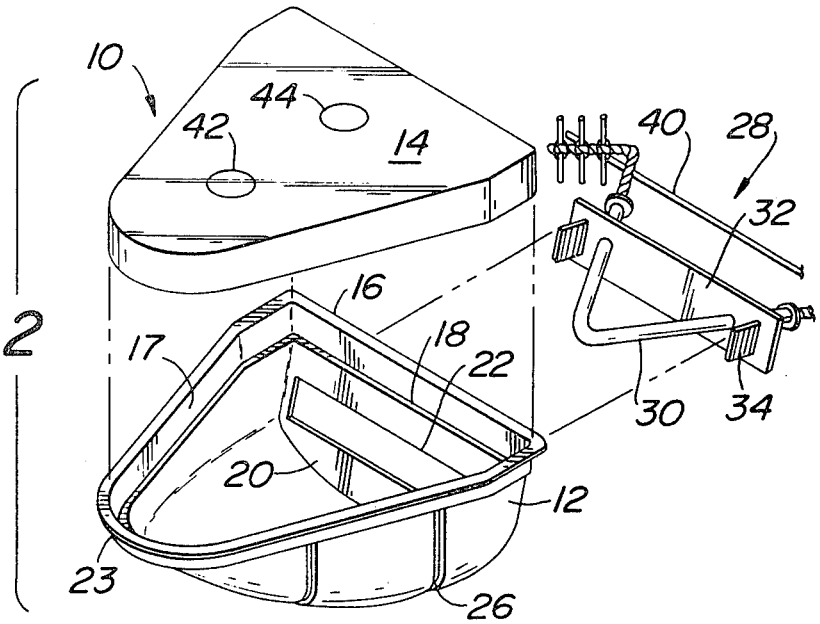
FIG. 2 is an exploded view of the enclosure in association with a pulling iron assembly.
Figure 3:
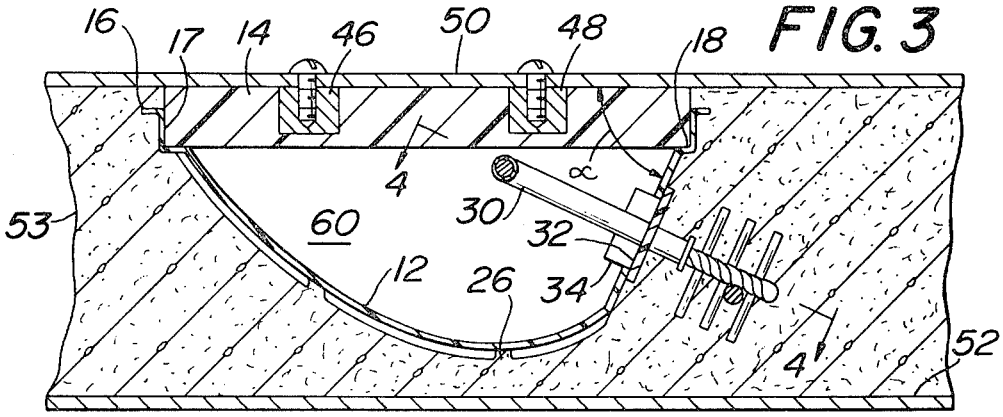
FIG. 3 is a sectional view through a mold of a vault showing the enclosure and pulling iron assembly mounted between the walls of the mold so as to be embedded in a wall of a vault.

As shown more clearly in FIGS. 2 and 3, the base 12 terminates at its upper edge in an outwardly extending flange 16. Below the flange 16, wall 17 of the base 12 has an inwardly extending shoulder 18. Cover 14 corresponds to the shape of wall 17 and has a tight sliding fit therewith. One wall of the base 12, such as wall 20, is provided with an opening 22. Wall 20 is preferably an end wall angularly disposed with respect to a line perpendicular to the major surface of the cover. As shown more clearly in FIGS. 1 and 3, the included angle alpha will vary slightly with the wall thickness of the vault within which the enclosure 10 is adapted to be embedded. The angle alpha is preferably 53° for an average wall thickness of 5 to 8 inches of precast concrete. As will be apparent from FIGS. 1–3, the width and height of the enclosure 10 is greater at the end adjacent wall 20 as compared with the opposite end 23. Thus, all sides of the base 10 taper toward the end 23 which is the narrowest and shallowest portion of the base 12.

The outer surface of the base 10 remote from the cover 14 is preferably provided with a plurality of longitudinally extending grooves 24 intersected by a plurality of transversely extending grooves 26. The grooves 24, 26 improve the adhesion between the base 10 and concrete. In addition, such grooves provide alternative means for mounting the enclosure 10 between the walls of the a mold. The inner surface of the base 10 is preferably smooth but will have slight ridges corresponding to the pattern of the grooves 24, 26 if the base 10 is vacuum formed.

Figure 4:
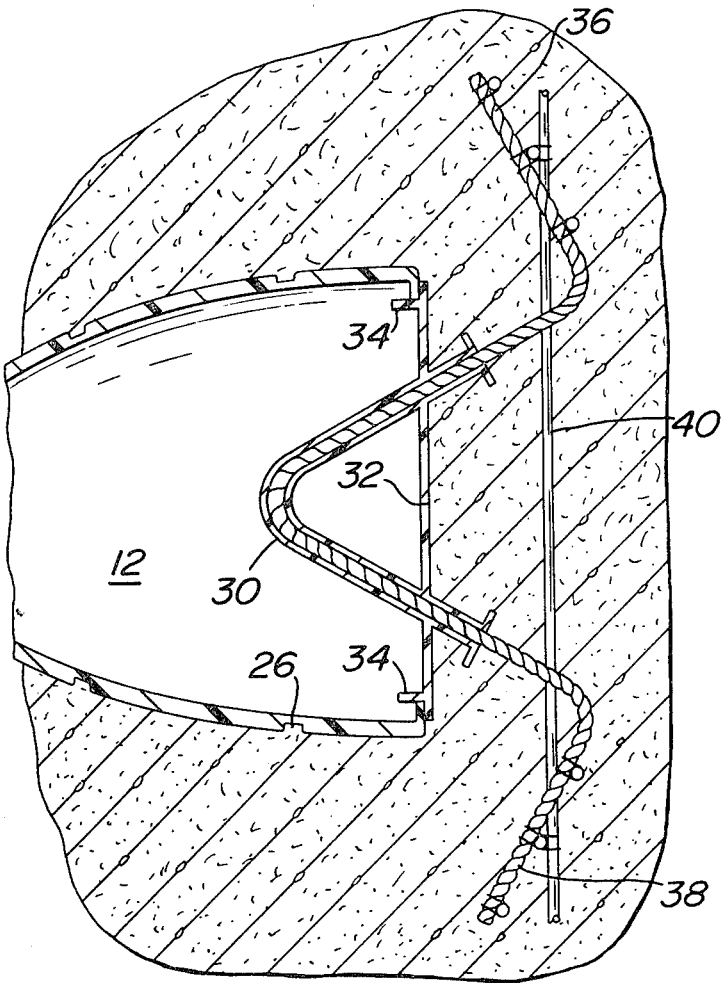
FIG. 4 is a sectional view taken along the line 4—4 in FIG. 3.

Referring to FIG. 2, there is illustrated a pulling iron assembly 28 similar to that disclosed in the above-mentioned patent. The pulling iron assembly 28 includes a pulling iron 30 which is generally V-shaped and made from cable coated on its outer surface with a polymeric plastic. The plastic coating on the pulling iron 30 is integral in one piece with a transversely extending plate 32. Plate 32 has one or more tabs 34 integral therewith and projecting therefrom. The width of tabs 34 corresponds to the height of the opening 22 and extend through said opening 22 when the assembly 28 is mounted between the walls 50, 52 of a mold as shown more clearly in FIG. 3. As shown more clearly in FIG. 4, the legs of the pulling iron 30 have angularly disposed extensions 36 and 38 which are adapted to be wired to a rebar 40.

The cover 14 is preferably made from rubber and substantially thicker than the walls of the base 12 as shown in FIG. 3. This facilitates reuse of the cover 14 and ease of handling with minimal likelihood of damage during usage. The enclosure 10 includes a means for mounting the same in a mold with a face of the cover 14 juxtaposed to a surface of a mold wall. Such means may take the form of recesses 42, 44 in the cover 14. A plug 46 on mold wall 50 is adapted to snugly enter the recess 42 while a similar plug 48 snugly enters the recess 44. In this manner, the cover is removably attached to the wall 50. It will be noted that the height of the cover 14 is such so that flange 16 will be spaced from the juxtaposed surface of the mold wall 50 when one face of the cover 14 is juxtaposed to said surface of the mold wall 50. As a result thereof, flange 16 will be embedded in a wall 53 which is cast from concrete between the mold walls 50, 52.

Figure 5:
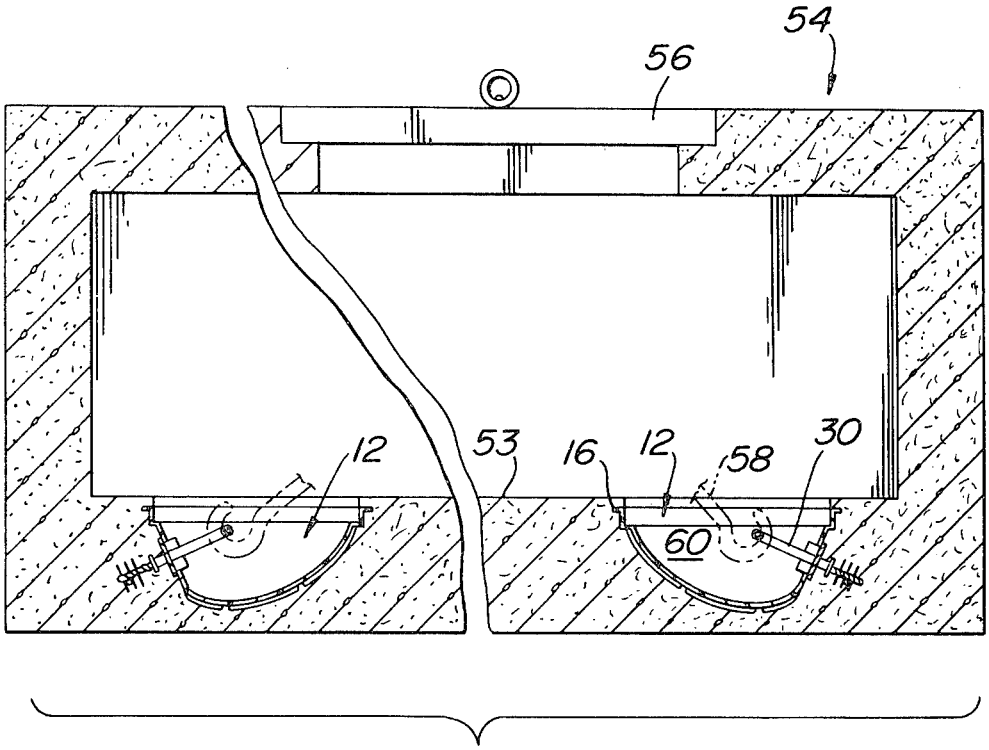
FIG. 5 is a sectional view through a vault showing the pulling iron and its enclosure in a wall of the vault.

As shown more clearly in FIG. 5, wall 53 is a bottom wall of the vault 54 but optionally could be a side wall of the vault. As shown in FIG. 5, a pair of the bases 12 have been embedded in the wall 53 with the internal cavity 60 exposed to the interior of the vault 54 for access by a worker. Due to wall 20 being disposed at the above-mentioned angle alpha, the pulling iron 30 will be angularly disposed as shown in FIG. 5 with sufficient access in the cavity 60 so that a hook, preferably connected to a pulley, may extend through the loop of the pulling iron 30. Also, it will be noted that the flange 16 is spaced from the top surface of the wall 53 and embedded therein so as to provide no exposed edges which would enable water to enter from the vault into a space between the concrete of walls 53 and the base 12. At the same time, the appearance of the enclosure for the pulling iron 30 is attractive and neat. The shape of the enclosure as described above minimizes the weak area of wall 53 at the location of the enclosure base.

Figure 6:
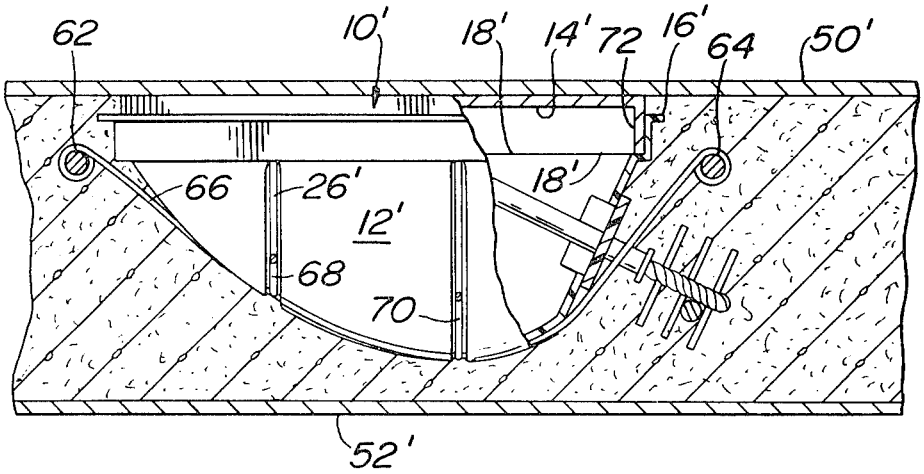
FIG. 6 is a view similar to FIG. 3 and showing another embodiment of the mounting means for mounting the enclosure between the walls of a mold.

In FIG. 6, there is illustrated another embodiment of the enclosure designated 10' with a different means for mounting the enclosure in a mold with a face of the cover juxtaposed to a wall of the mold. Corresponding elements of enclosures 10, 10' are provided with corresponding primed numerals. The base 12' is identical with the base 12.

The enclosure 10' is mounted between the walls 50', 52' by being secured to rebars 62, 64. A wire 66 extends between the rebars 62, 64 and along a longitudinally extending groove corresponding to groove 24. The wire 66 is tightened so as to cause one face of the cover 14' to be juxtaposed to and in contact with a surface of the mold wall 50'. Additional wires 68, 70 may extend between other rebars not shown while being disposed in transverse grooves 26'. In this manner, the cover 14' need not be provided with recesses corresponding to recesses 42, 44 and mounting plugs need not be attached to the mold wall 50'.

In FIG. 6, the cover 14' is also reusable and preferably is made from a polymeric plastic as described above but with substantially the same wall thickness as that of the base 12'. Cover 14' is supported from a shoulder 18' by way of a flange 72 which is sufficient in length so as to result in flange 16' being spaced from the wall 50'. The enclosure 10' is otherwise identical with that described above.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for recessing a pulling iron in a wall of a vault comprising an enclosure defined by a base and a removable cover, said enclosure having a cavity therein, said cover overlying one side of the cavity, a wall of said enclosure base having an elongated opening of length a plurality of times its width through which the V-shaped central portion of a pulling iron may extend for positioning of the pulling iron in the cavity, and means for mounting said enclosure in a mold with a face of said cover juxtaposed to a wall of a mold, said base having an outwardly extending flange at said one side of the cavity, the elongated opening being in a planar wall of said base which is at an acute angle with respect to said base flange, said base having a shoulder inwardly of said base flange and adjacent said one side of the cavity, said cover being supported on said shoulder, said shoulder being interposed between said planar wall and said base flange.

2. Apparatus in accordance with claim 1 wherein said cover has a perpendicular flat flange about its periphery, the width of said cover flange being greater than the distance from said base flange to said shoulder so that said cover projects for a distance beyond said base flange and said base flange will be spaced from said wall of the mold when the cover is in contact with the same wall of the mold.

3. Apparatus in accordance with claim 1 wherein said base is arcuately shaped from the edge of said planar wall to the tip of the base opposite said planar wall.

4. Apparatus in accordance with claim 1 wherein the elongated opening is the sole opening in the walls of said base.

5. Apparatus comprising a concrete vault, a wall of said vault having an enclosure base embedded therein with a cavity exposed to the interior of said vault, and a pulling iron having its V-shaped cantral portion extending through an elongated opening of length a plurality of times its width in a portion of one end of said base so as to be disposed within the cavity at an acute angle with respect to a surface of said wall, said base being higher and wider adjacent said one end than at the other end.

6. Apparatus in accordance with claim 5 wherein said base has an outwardly extending flange spaced from said surface of said wall and embedded in said wall.

7. Apparatus in accordance with claim 5 wherein said base is made from a polymeric plastic with intersecting grooves on a surface thereof remote from said wall, and including anchoring members in some of the grooves for anchoring said enclosure base to reinforcement bars in said wall.

8. Apparatus in accordance with claim 5 wherein the elongated opening is the sole opening in the walls of said base.

9. Apparatus according to claim 5 wherein the deepest portion of the cavity is between the ends of said enclosure, the V-shaped central portion of the pulling iron extends through the elongated opening so as to be disposed within the cavity adjacent said deepest portion, said base has an outwardly extending flange spaced from said surface of said wall and embedded in said wall, and said base is made from a polymeric plastic with intersecting grooves on a surface thereof in contact with the concrete of said wall.

10. Apparatus for recessing a pulling iron in a wall of a vault comprising a non-circular enclosure defined by a base and a removable cover, said enclosure having a non-circular cavity therein, said cover overlying one side of the cavity, said base having a wall with an elongated opening of length a plurality of times its width through which the V-shaped central portion of a pulling iron may extend for positioning of the pulling iron in the cavity, and means for mounting said enclosure in a mold with a face of the cover juxtaposed to a wall of the mold.

11. Apparatus in accordance with claim 10 wherein said enclosure is made from a polymeric plastic and has intersecting grooves on an exposed surface thereof remote from said cover, said grooves constituting at least a portion of said mounting means.

12. Apparatus in accordance with claim 11 including anchoring members in some of the grooves for anchoring said base to reinforcement bars in said vault wall.

13. Apparatus in accordance with claim 10 wherein the enclosure is made from a polymeric plastic which is higher and wider at one end than at the other end, said base wall is substantially planar and is located at said one end, said base has an outwardly extending flange about its periphery adjacent to said one side of the cavity, said cover projects for a distance beyond said base flange and is supported by the inner periphery of said enclosure, and said base wall is at an acute angle with respect to said flange.

14. Apparatus in accordance with claim 10 wherein said enclosure is made from a polymeric plastic material, said enclosure being higher and wider at one end than at the other end, said base wall having the elongated opening being located at said one end.

15. Apparatus in accordance with claim 10 wherein said cover has a perpendicular flat flange about its periphery, and said base has a shoulder on its inner surface adjacent said one side of the cavity for receiving said cover flange and supporting said cover.

16. Apparatus in accordance with claim 15 wherein said mounting means includes recesses in said cover for for snugly receiving plugs on a mold wall.

17. Apparatus in accordance with claim 15 wherein said base has an outwardly extending flange about its periphery adjacent to said one side of the cavity, and the width of said cover flange is greater than the distance from said base flange to said shoulder so that said cover projects for a distance beyond said base flange and said base flange will be spaced from a wall of a mold when the cover is in contact with the same wall of the mold.

18. Apparatus comprising a concrete vault, a wall of said vault having an enclosure base embedded therein with a cavity exposed to the interior of said vault, the deepest portion of said cavity being between the ends of said enclosure, a pulling iron extending through an opening in a portion of said base so as to be disposed within the cavity adjacent said deepest portion and being at an acute angle with respect to a surface of said wall, said base having an outwardly extending flange spaced from said surface of said wall and embedded in said wall, said base being made from a polymeric plastic with intersecting grooves on a surface thereof in contact with the concrete of said wall, and anchoring members in some of the grooves for anchoring said base to reinforcement bars in said wall.

19. Apparatus for recessing a pulling iron in a wall of a vault comprising a non-circular enclosure defined by a base and a removable cover, said enclosure having a cavity of non uniform depth therein, said cover overlying one side of the cavity and having a perpendicular flat flange about its periphery, a wall of said enclosure base having an elongated opening of length a plurality of times its width through which the V-shaped central portion of a pulling iron may extend for positioning of the pulling iron in the cavity, and means for mounting said enclosure in a mold with a face of said cover juxtaposed to a wall of a mold, said base having an outwardly extending flange at said one side of the cavity, the elongated opening being in a planar wall which is at an acute angle with respect to said base flange, said enclosure being made from a polymeric plastic with intersecting grooves on a surface thereof remote from said one side of the cavity, said base being higher and wider adjacent said planar wall than opposite said planar wall, said base having a shoulder inwardly of said base flange and adjacent said one side of the cavity for receiving said cover flange and supporting said cover.

* * * * *